United States Patent [19]

Johnston

[11] Patent Number: 4,926,593

[45] **Date of Patent: * May 22, 1990**

[54] TRUSS ARRANGEMENT

[75] Inventor: Ronald J. Johnston, Georgetown, Canada

[73] Assignee: Aluma Systems Ltd., Downsview, Canada

[ * ] Notice: The portion of the term of this patent subsequent to Nov. 29, 2005 has been disclaimed.

[21] Appl. No.: 277,006

[22] Filed: Nov. 28, 1988

Related U.S. Application Data

[63] Continuation of Ser. No. 813,242, Dec. 24, 1985, Pat. No. 4,787,183.

[30] Foreign Application Priority Data

Dec. 27, 1984 [CA] Canada ..... 471047

[51] Int. Cl.[5] ..... E04G 11/36

[52] U.S. Cl. ..... 52/126.4; 52/126.5; 52/646; 249/29

[58] Field of Search ..... 52/126.4, 126.5, 126.7, 52/637, 641, 646, 650, 693, 731, 732

[56] References Cited

U.S. PATENT DOCUMENTS

| | | | |
|---|---|---|---|
| 4,514,940 | 5/1985 | Manderla | 52/126.1 |
| 4,787,183 | 11/1988 | Johnston | 52/126.4 |

FOREIGN PATENT DOCUMENTS

| | | |
|---|---|---|
| 1204096 | 5/1986 | Canada . |
| 934577 | 10/1946 | France . |
| 1229330 | 7/1959 | France . |

*Primary Examiner*—
*Assistant Examiner*—Jerrold D. Johnson
*Attorney, Agent, or Firm*—Arnold, White & Durkee

[57] ABSTRACT

A structural member for use in concrete forming structures and the like is disclosed. The member comprises a pair of spaced parallel tubular members interconnected by means of opposed webs. The combination defines an enclosure extending the length of the tubular members. Each of the webs attaches to a side of the tubular member opposite the enclosure. The outer surface of each web includes opposed flanges, which in combination with the web, define an open bolt slot that extends the length of the structural member. This structural member is particularly useful as an upright in concrete shoring.

6 Claims, 6 Drawing Sheets

TRUSS ARRANGEMENT

This application is a continuation of U.S. Application Ser. No. 813,242, filed Dec. 24, 1985 now U.S. Pat. No 4,787,183.

BACKGROUND OF THE INVENTION

The present invention relates to forms and components thereof for use in concrete forming and in particular, forms and components thereof which include trusses for forming of concrete floors. The forms preferrably are of the type that are adapted to be lifted by crane between floors of a building during the construction thereof, thereby substantially reducing the time required to set up the form for pouring of the next floor. In particular, the invention is directed to forms which provide additional flexibility and convenient adjustment to define a system for forming of ceilings of different heights or vaulted ceilings.

Flying forms, which are essentially a number of interconnected truss structures adapted to be moved on rollers or the like beyond the building and lifted to the next floor, greatly reduce the required labour necessary for set-up of the forms. Forms of this type include U.S. Pat. Nos. 4,077,172, 3,966,164, and 3,787,020 as but some examples. Recent architectural design to provide additional strength has used concrete ceilings provided with concrete beams which require a stepped ceiling. It is also common to provide a concrete sill at the edge of the floor and a downwardly extending edge portion from the ceiling to reduce the window size. Such structures present additional problems as "packing" is required on the top surface of the truss to accomodate the changing heights of the ceiling. This "packing" is commonly made of wood and beams and as such is very labour intensive and costly. The amount of "packing" can be quite substantial as the top chord of the truss can only be located below the lowest position of the ceiling. When the truss is collapsed for movement between floors, by the lower legs being retracted within the truss, the effective height of the truss is the extent to which the legs may extend below the truss, the height of the truss and the height of any "packing" material secured above the truss. Often this effective height is such that flying forms cannot be used due to the reduced clear area between the concrete sill and downwardly extending ceiling edge.

According to the present invention, a system is provided which uses an intermediate truss which has extendable legs associated therewith. Certain of the legs are associated with the truss to extend below the truss for engaging a support surface and other legs extend above the truss to engage a load collecting beams. Movement of the truss between floors is possible as the lower extension legs collapse or telescope within the truss. The truss is such that the legs each telescope within their own associated tube or recess of the truss whereby the length of the leg can be approximately equal to the height of the truss and, it can be extended further by use of a screw jack. The amount of "packing" and the labour associated therewith is reduced as the extendable legs above the truss are adjusted to accomodate the height of the ceiling and position load collecting beams. As each leg is independently movable within the truss, maximum height of the truss and legs is increased by about the height of the truss as legs extend top and bottom. An upright member for a truss according to an aspect of the invention comprises two paired members disposed in parallel relation and connected to each other by connecting means intermediate the said members. Each of the members includes generally planar opposed parallel bearing surfaces and each bearing surface on one member is colinear with a bearing surface on the other tube member.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
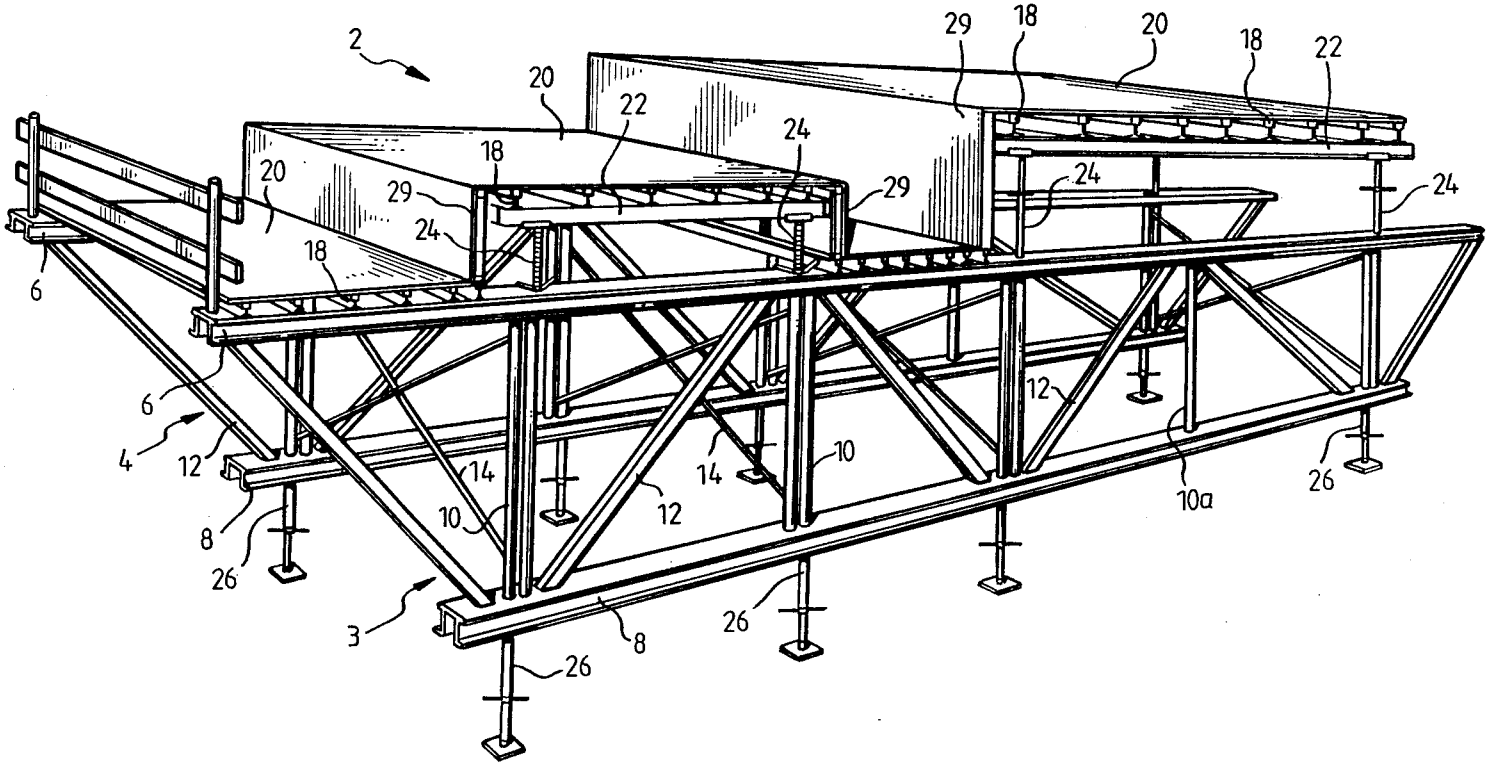
FIG. 1 is a partial perspective view of a truss used in concrete forming.

The concrete forming system generally shown as 2 in FIG. 1 has parallel trusses 3 and 4, each having a top chord member 6 and a bottom chord member 8, spaced by upright members 10 and truss diagonal braces 12. The trusses are interconnected by the braces 14. Load collecting beams 22 preferrably run parallel with the top chord 6 of each truss or perpendicular to the top chords 6. The sheeting material 20 is secured atop the beams 18 and at least partially defines the concrete form. A number of trusses 6 can be interconnected for forming larger areas and can be moved as a unit depending upon the construction site and the crane capacity. In the system shown in FIG. 1, 3 different concrete forming levels are shown for accomodating concrete beams and stepped areas formed as part of the floor. Load collecting beams 22 are appropriately positioned by extendable legs 24 or screw jacks as shown, of a size for receipt within an upright member 10. Extendable legs 26 are positioned adjacent the bottom edge of the truss, support the truss at the required height above a support floor. Therefore, the truss, defined between the top chord member 6 and the bottom chord member 8, is positionable at various spacings above a support floor by adjusting the lower extendable legs 26. Extendable legs 24 allow for fast positioning of load collecting beams 22, in accordance with the desired ceiling profile. The legs 24 and 26 are telescopically received within the upright members 10 without interference between leg 24 and 26. This occurs as the legs are adjacent to each other and each upright member 10 has the capacity for receiving two legs. This in effect allows the maximum height of the concrete forming system to be substantially increased relative to the spacing between the top chord 6 and the bottom chord 8 and results in a more efficient and flexible system as the amount of "packing" required has been reduced and the ability to easily define different concrete support levels has been improved. In the system as shown in FIG. 1, "packing" 29, illustrated as 2×4's nailed to the sheeting material 20, is provided at each change in level of the form. The packing for a given level has been replaced by load collecting beams 22 supported by legs 24. Normally it will not be necessary for all uprights 10 to receive extendable legs and some may merely act as a structural member such as upright 10*a*.

Figure 2:
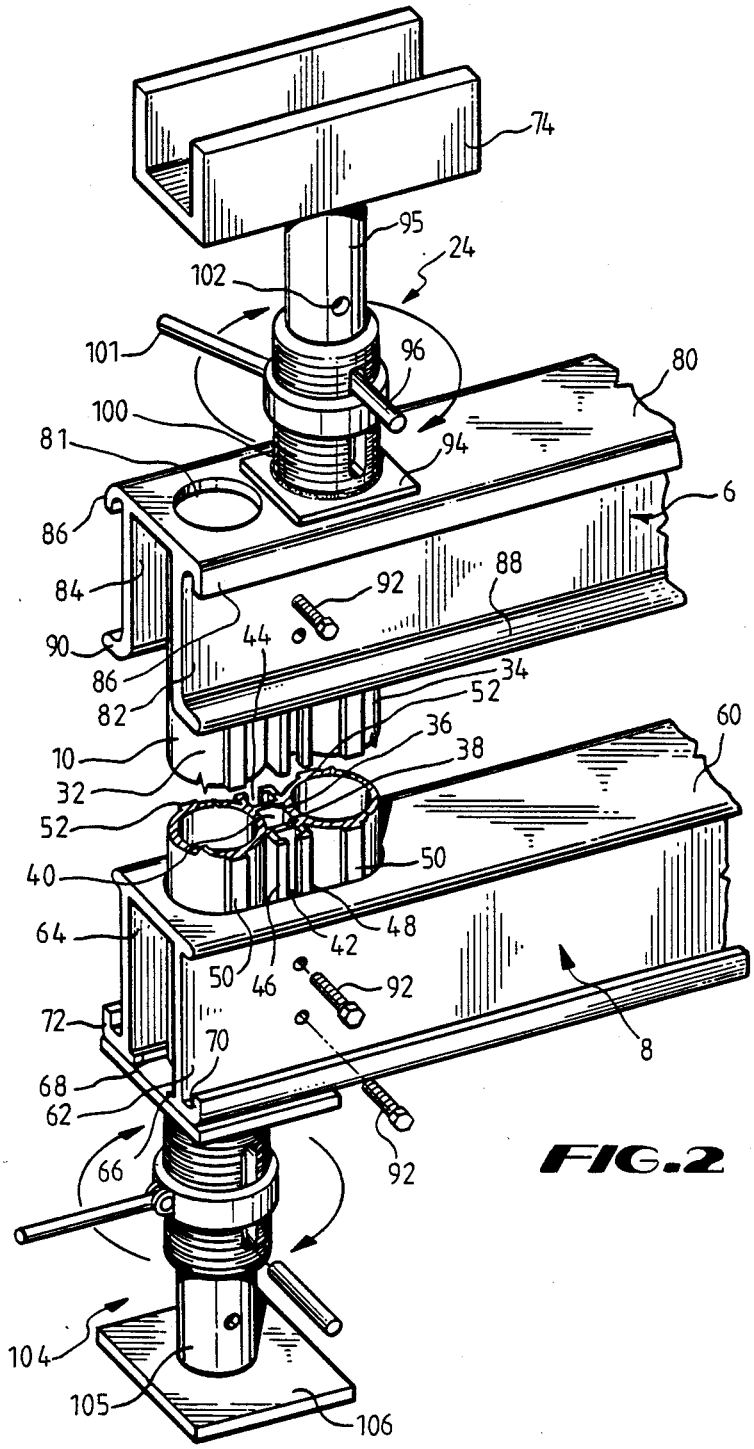
FIG. 2 is a partial perspective view of a portion of a truss illustrating the co-operation of the upright support members with the top and bottom chords of the truss.

Details of the telescope receipt of extendable leg 24 and extendable leg 26 within one of the upright members 10 can be appreciated from FIG. 2, where upright member 10 has two opposed members 32 and 34, each of a size for receiving an extension leg. Webs 36 and 38 in combination with members 32 and 34, define a closed cavity 40. This cavity is advantageously used to receive bolts 92 for connecting the upright member 10 to the chord members 6 and 8. As the bolts pass through the cavity 40, the hollow portion within each of the tube members 32 and 34 remains clear and allows extendable legs 24 and 26 to collapse or telescope within the full length of each tube member. To the exterior of web members 36 and 38, bolt slots 42 and 44 are provided. Bolt slot 42 has exterior flanges 46 and 48 which define a planar face for engaging the interior surface of the side plate 62 of the bottom chord member 8 and the interior surfaces of the side plate 82 of the top chord member. Bolt slot 44 includes similar flanges and cooperates with side plates 64 and 84. In addition each tube member includes opposed thickened portions 50 and 52 having a planar outer face. The face of portions 50 are co-planar with flanges 48 and 46 which also engage the interior surface of the bottom chord member and the top chord member to provide a more secure fit of the upright member within the chord members. Portion 52 cooperates with the flanges of bolt slot 44 to engage the opposite side plates of the top and bottom chord. The blots 92 pass through the side plates of the chord members and through the bolt slots to apply the pressure adjacent these planar engaging faces to increase the structural integrity of the system. The uprights are preferrably extruded of a magnesium or aluminum alloy although not limited thereto.

To top chord member 6 includes a top plate 80 which extends beyond the side plates 82 and 84 to define downwardly extending lips 86, either side of the longtitudal axis of the top chord member 6. These lips 86 are used for clamping of additional components to the top chord member. The top plate 80, includes a circular opening 81 to allow access to the hollow interior portions of the tube members 32 and 34 whereby the extendable leg 24 can be received in either of the tube members 32 and 34.

The bottom chord member 8, is open on the bottom and as such the hollow interior portions of tube members 34 and 36 are exposed at the bottom of the chord member. However, the bottom chord does include inwardly extending lips 66 and 68, which bearingly engage with the lower surfaces of the thickened portions 50 and 52 and the lower portion of the bolt slots 42 and 44. The top plate 60 of the bottom chord member has an aperture therein for receiving the upright member 10, which is held within the bottom chord member by the bolts 92. The lips 66 and 68 reduce the shear stress that must be carried by the bolts 92. The bottom chord member also includes outwardly extending lips 70 and 72 having the edge thereof flared upwardly. This lip arrangement it used for securing of components to the bottom chord member and increases the stiffness of the bottom chord member.

The top chord member 6, the bottom chord member 8 and the upright members 10, are preferrably extruded of a light weight alloy of aluminum or magnesium although a version of the system made of steel can be used if the increased weight can be accomodated. The extendable legs 24 and 26 can be of many different forms and the form shown for leg 24 includes a support plate 94, having a externally threaded stub tube 100, having a rotatable member 101, thereabout. The leg 24 includes an extension leg rod 95, having a number of holes 102 therein, for receiving the pin member 96. Therefore, the leg is roughly adjusted according to the length required, by proper placement of pin member 96 in one of the holes 102 and member 101 is then adjusted to more accurately position the channel bracket 74 which supports the load collecting beam 22. In this case, the extension leg rod 95, is telescopically received within tube member 34 and the extension rod member 105 of the lower leg is telescopically received within tube member 32. Rod 95 and rod 105 will overlap when the system is arranged in its most compressed or compacted state. A similar type leg arrangement 104, has been shown at the bottom edge of the bottom chord 8, however, these legs are but examples of what can be used and the invention is not limited to these legs. The important point to note, is that the position of the extendable leg rods 95 and 105 intermediate the top chord 6 and the bottom chord 8 can overlap and, therefore, the effective maximum height of the system without considering screw jacks etc. securable to the legs is generally significantly greater than twice the spacing between the bottom chord 8 and the top chord 6. The lower leg can be fully received within the truss when the system is "compacted" independent of the amount of upper leg received within the truss.

Figure 3:
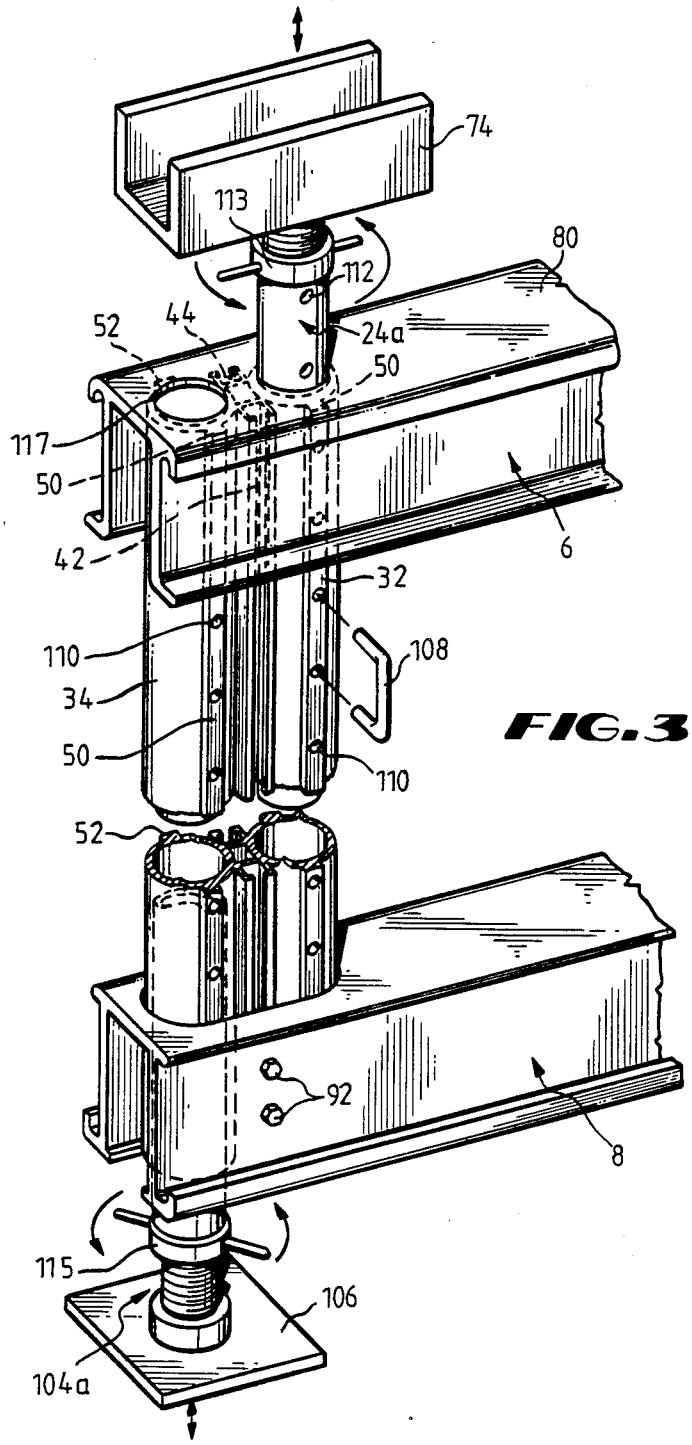
FIG. 3 is a partial perspective view showing additional details of the co-operation between the upright member and the top and bottom chords of the truss.

FIG. 3 shows a similar type arrangement, however, in this case the tube members 32 and 34 of the upright member 10 have a number of holes 110 through the thickened portions 50 and 52 which are alignable with holes 112 of leg 24*a* and 104*a*. A locking U-bar 108 is receivable in adjacent holes 110 of the upright member 10 for passing through holes 112 in the leg 24*a* or 104*a* for providing a rough adjustment of the position of the channel bracket 74 above the top chord member 6 or for spacing of the support plate 106, a certain distance below the bottom chord member 8. More accurate adjustment is achieved by turning of the threaded collars 113 of leg 24a or collar 115 of leg 104*a*. In contrast to the structure of FIG. 2 top plate 80 has a somewhat elongate opening 117 to allow leg 24*a* to telescope within the hollow interior of tube member 32. This allows the user to position leg 24*a* to telescope within tube 32 or within tube 34 and appropriately position the bottom leg to telescope within the other tube. Therefore, in the preferred embodiment both tubes 32 and 34 are opened to the upper side of the top chord 6, and are opened to the lower periphery of the bottom chord 8. The elongate opening 117 is not oversized and, therefore, the thickened portions 50 and 52 of each upright member 10 will engage the underside of top plate 80 and similarly the bolt slots 42 and 44 will also engage the top plate. The advantage of two openings rather than one elongate opening 117, is that the portion of the upper chord generally between the tubes remains intact and provides additional bearing surface for upright 10.

Figure 4:
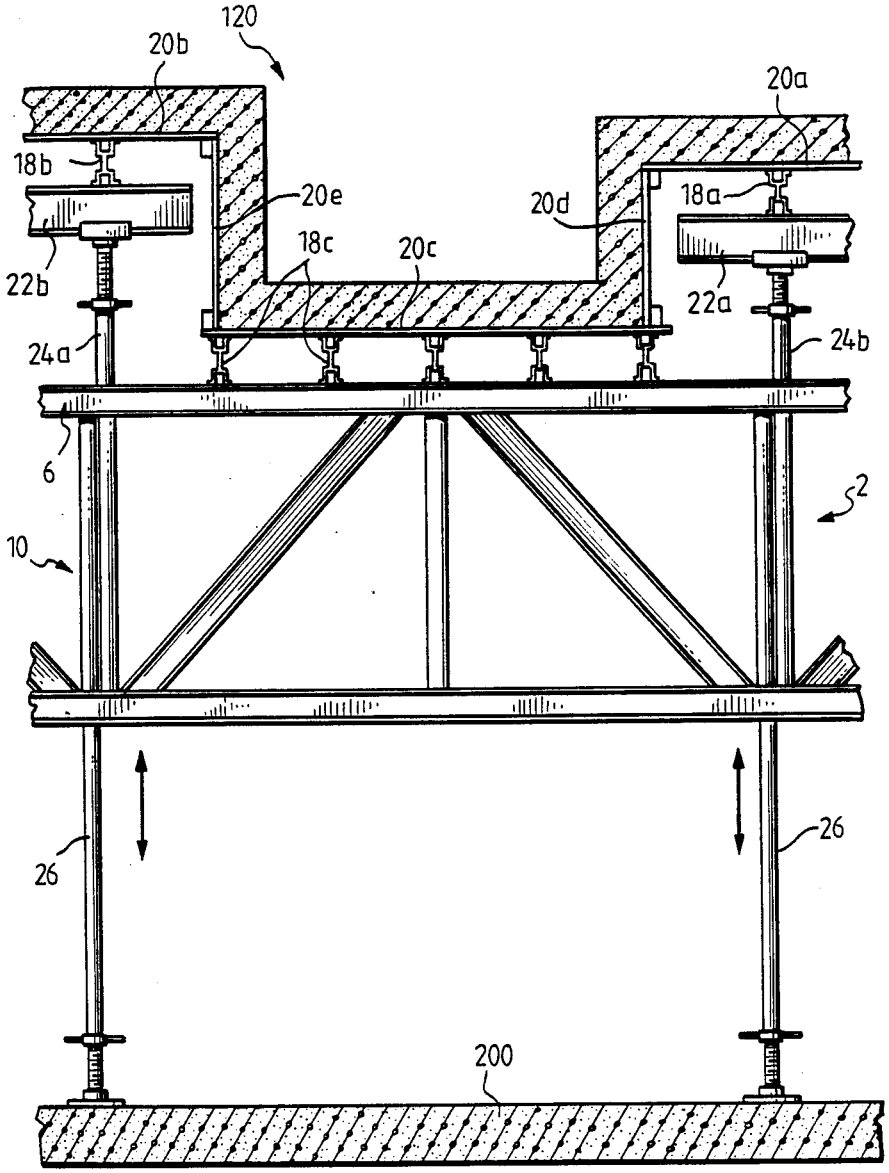
FIG. 4 is a partial front view of the concrete forming system showing a partial section of a vaulted ceiling.
Figure 5:
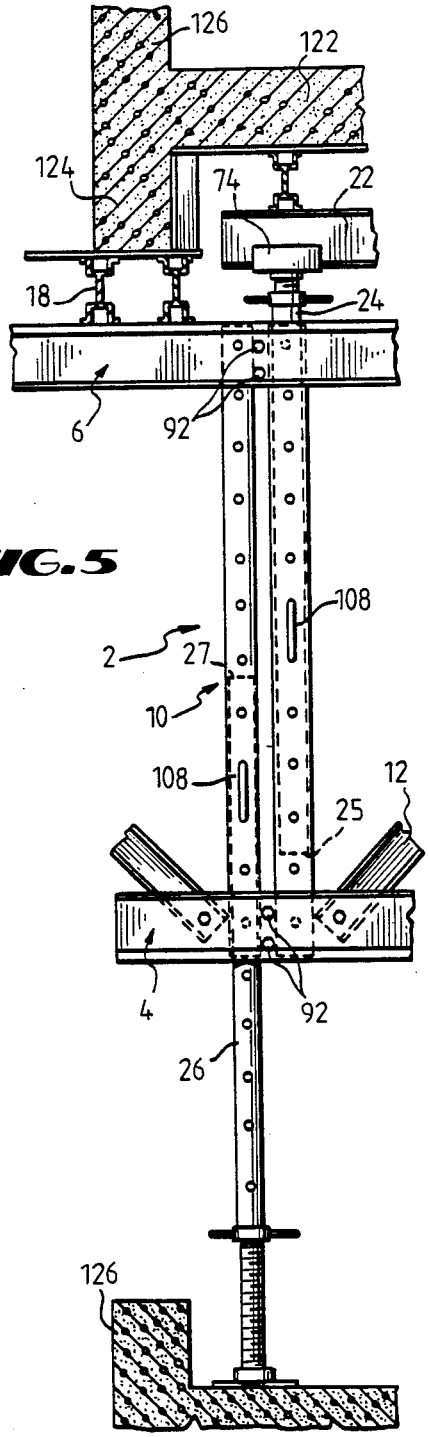
FIG. 5 is a partial front view of a portion of the truss system adapted for forming of a ledge at the edge of the floor.
Figure 6:
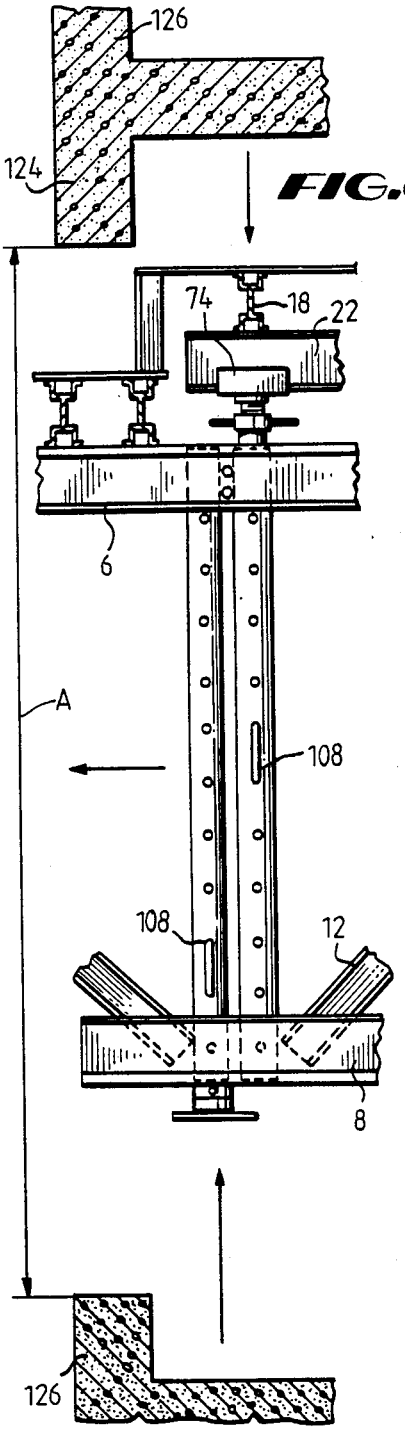
FIG. 6 is view similar to FIG. 5 with the truss in its retracted state for removal from between concrete floors.

FIGS. 4, 5 and 6 illustrate how the concrete forming system of the present application can advantageously be employed. In FIG. 4 a portion of a vaulted ceiling 120 is shown, where load collecting beam **22*b* supports beam 18*b* which in turn supports the sheeting material 20*b* for defining a portion of the form defining the multi-level ceiling. Beams 18*c* can be directly supported on the top chord member 6 of the truss and support sheeting material 20*c* for defining the lower surface of the ceiling. Load collecting beam 22*a* supports beams 18*a* and sheeting material 20*a* for defining another step in the ceiling. In addition, sheeting 20*d* and 20*e* are shown deleting the vertical surfaces of the vaulted ceiling and nailed to the upper and lower level via a number of 2×4's. When it is desired to remove the system 2 from between the lower floor 200, the lower legs 26 are essentially fully telescoped within the upright members 10 and the legs 24*a* and 24*b* preferrably remain at their adjusted position with a certain portion thereof within the upright member 10. Thus the surface 20*b*, 20*c* and 20*a* and any packing will maintain their position relative to the top chord member 6. The system is most effective when the truss is of a height whereby the legs 26 and associated jack screw are close to fully extended whereby the system can pass through a gap slightly larger than the truss and the structure thereabove defining the concrete forming surface. If the height is still too great, packing for surface 20*e* and 20*d* may be removed and legs 24*a* and 24*b*** telescoped within the truss. Normally this is not required but is advantageous in that the ability of the system to move through a narrow space is further increased.

In FIGS. 5 and 6, the system is shown supporting a portion of the concrete floor adjacent the edge of a building. In this case, the floor of the building has a bottom sill 126 projecting upwardly therefrom, and a downwardly projecting portion 124 which extends below the lower surface of the newly poured floor 122. Therefore, the gap between portion 124 and 126 is defined by the spacing "A", and as such the system must compress or collapse to a height less than the spacing "A" to allow the truss to be moved as a unit outwardly through the gap "A" to allow flying of the form to the top surface of the newly poured floor 122.

In FIG. 5, it can be seen that end 27 of leg 26 and end 25 of leg 24, are positioned such that there is an overlap between legs 24 and 26. In this case, the full height capacity of the system was not required. From a consideration of FIG. 6, it can be seen that the end 25 remains at the adjusted position within the upright member 10 and end 27 telescopes to move to be adjacent the top chord 6. Therefore, the ability of the system to compress is independent of legs 24 as each leg 24 and 26 moves independently within the upright member 10. The overall height of the truss can greatly be reduced in its compressed state by telescopic receipt of legs 24 in the truss. This provides a ratio of maximum height of the combined truss and legs independent of jack screws relative to minimum height substantially greater than two and up to about three. This is particularly advantageous in the present design of buildings as it is desirable to have vaulted-type ceilings with downwardly extending ledges where the actual space for moving of the truss exterior of the building has been substantially reduced.

Figure 7:
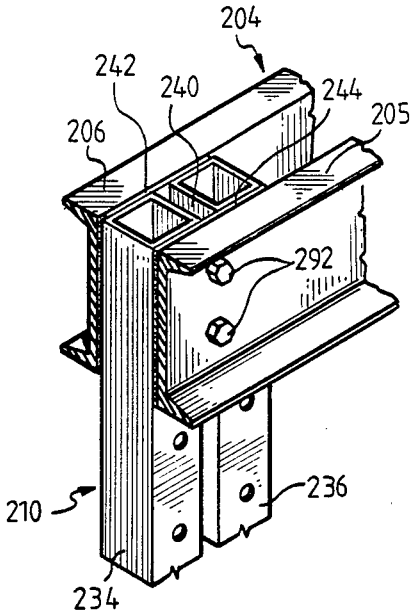
FIG. 7 is a partial cut-away perspective view of the truss system with a modified construction.
Figure 7:
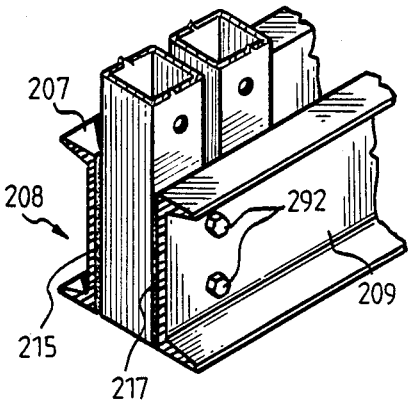
Figure 8:
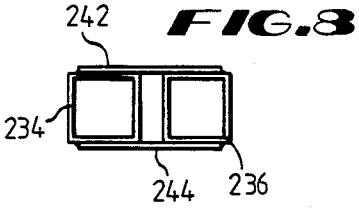
FIG. 8 is a top view of the modified upright.
Figure 9:
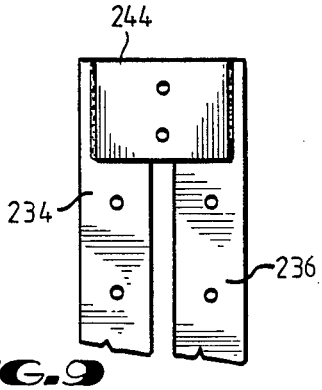
FIG. 9 is a partial sideview of the modified upright.

A modified structure is shown in FIGS. 7 through 9, which can be fabricated from commonly available components. The upright 210 has two spaced square tube members 234 and 236 secured and spaced by plates 242 and 244 to define cavity 240 intermediate the tube member 234 and 236 and the top chord 204 defined by opposed channels 205 and 206. Plates 242 and 244 are preferrably welded to tube members 234 and 236. The bottom chord 208 defined by channels 207 and 209, is similiarly attached to the upright 210 secured either side by plates 215 and 217. Bolts 292 pass through the channels and the plates to secure upright 210 to the bottom chord 208 and the top chord 204.

The use of tubes 234 and 236 of square or rectangular section is preferred as welding of plates 242, 244, 215 and 217 thereto is simplified. It is also possible to use tubes of other cross section such as circular and oval although securement to the top and bottom chord is slightly more difficult. The use of welded plates as above will adequately secure the chords to the upright member.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A structural member for use in a concrete forming structure comprising a pair of tubular members disposed in parallel relation with each tubular member integral with opposed webs which in combination with said tubular members define an enclosure extending the length of said tubular members, each web to a side opposite said enclosure including opposed flanges which in combination with the particular web define an open bolt slot extending in the length of said tubular members.

2. A structural member as claimed in claim 1 wherein the member is of an extruded aluminum alloy.

3. A structural member as claimed in claim 2 wherein each tubular member is generally circular in cross section.

4. A structural member as claimed in claim 3 wherein said webs are of a width slightly greater than the width of the bolt slot.

5. A structural member as claimed in claim 4 wherein each tubular member includes two opposed outwardly extending thickened portions terminating in a generally planar face which is generally coplanar with the outer faces of one of said bolt slots and a corresponding thickened portion of the other tubular member.

6. A structural member as claimed in claim 5 wherein each tubular member includes a tubular height adjustment means at least partially received therein with the tubular height adjustment means extending from opposite ends of said structural member, each tubular height adjustment means being selectively movable to a position within a tubular member such that a portion of the tubular height adjustment means overlap.

* * * * *

UNITED STATES PATENT AND TRADEMARK OFFICE

CERTIFICATE OF CORRECTION

PATENT NO. : 4,926,593

DATED : May 22, 1990

INVENTOR(S) : Ronald J. Johnston

It is certified that error appears in the above-identified patent and that said Letters Patent is hereby corrected as shown below In column 1, before the paragraph beginning "According to" please insert the following heading: --SUMMARY OF THE INVENTION--.

Signed and Sealed this

Twenty-eighth Day of May, 1991

*Attest:*

*Attesting Officer*

HARRY F. MANBECK, JR.

*Commissioner of Patents and Trademarks*